US005344228A

United States Patent [19]

Kovarik et al.

[11] Patent Number: 5,344,228

[45] Date of Patent: Sep. 6, 1994

[54] THIN OFFSET DRAWER SLIDE WITH PROGRESSION ROLLER

[75] Inventors: Franz Kovarik, Limburg, Fed. Rep. of Germany; James Ongley, Glendale, Calif.

[73] Assignee: Accuride International Inc., Santa Fe Springs, Calif.

[21] Appl. No.: 895,264

[22] Filed: Jun. 8, 1992

[51] Int. Cl.[5] ..... A47B 88/00

[52] U.S. Cl. ..... 312/334.9; 312/334.17; 312/334.18; 384/18; 384/21

[58] Field of Search ..... 312/334.9, 334.33, 334.37, 312/334.38, 334.11, 334.17, 334.26, 334.46, 334.18; 384/18, 21

[56] References Cited

U.S. PATENT DOCUMENTS

| | | | |
|---|---|---|---|
| 2,675,277 | 4/1954 | McClellan | 384/18 |
| 3,679,275 | 7/1972 | Fall et al. . | |
| 3,857,618 | 12/1974 | Hagen et al. . | |
| 3,901,564 | 8/1975 | Armstrong . | |
| 3,901,565 | 8/1975 | Hagan et al. | 384/18 |
| 3,912,341 | 10/1975 | Stein | 384/18 |
| 3,966,273 | 6/1976 | Hagen . | |
| 4,469,384 | 9/1984 | Fler et al. . | |
| 4,662,761 | 5/1987 | Hoffman . | |
| 5,022,768 | 6/1991 | Baxter . | |

FOREIGN PATENT DOCUMENTS

| | | | |
|---|---|---|---|
| 659534 | 10/1951 | United Kingdom . | |
| 783826 | 10/1957 | United Kingdom | 312/334.9 |

*Primary Examiner*—Brian K. Green
*Attorney, Agent, or Firm*—Christie, Parker & Hale

[57] ABSTRACT

A thin profile drawer slide apparatus for slidably supporting a heavy drawer in furniture, comprising symmetrical, identical channel members for slidably attaching the apparatus to a drawer and an article of furniture, a plurality of bearings slidably retained in the channel members by bearing retainers, and by an intermediate slide member. The intermediate slide member comprises the unitarily formed combination of a generally vertical central wall, a first bearing raceway joined to an end of the central wall, and a second bearing raceway joined to an arcuate wall extending angularly outwardly from the first bearing raceway, whereby the first and second bearing raceways are vertically and angularly separated. The ball bearings are arranged in four linear, slightly offset sets. Use of a single intermediate slide member with raceways for four separate sets of bearings provides a thin, strong drawer slide for carrying heavy loads. In an alternate embodiment, the central wall of the intermediate slide member comprises a generally rectangular window with a progression roller mounted therein on a vertical axis of rotation. The roller exerts friction on the inner faces of the channel members by compression against the inner faces when the roller is moved. Edges of window act as a detent on the roller and also urge the slide closed when the slide is brought to rest with the roller against one of the edges. The windows relieve compression of the roller when the slide is fully closed.

12 Claims, 7 Drawing Sheets

THIN OFFSET DRAWER SLIDE WITH PROGRESSION ROLLER

FIELD OF THE INVENTION

The present invention generally relates to slide mechanisms for drawers slidable in articles of furniture. The invention specifically relates to a three-part heavy-duty miniature ball bearing drawer slide mechanism with offset outer channel members and a progression roller which assists closure and detent of the slide.

BACKGROUND OF THE INVENTION

To reduce friction and enable a drawer to withstand a heavy load, drawer slides for furniture in file cabinets and other furniture employ bearings to reduce wear, Professional furniture for medical, industrial, and engineering applications often requires thin drawers and thin drawer slides. Such applications also require a heavy-duty slide. Four sets of ball bearings are usually required to bear a typical load when full extension is required. However, the use of four separate sets of ball bearings poses obstacles to miniaturization of the slide. Furniture designers desire the cross-section profile of the slide to be thin in the horizontal direction, thereby enabling a drawer to be as wide as possible compared to the opening in which it slides. Moreover, designers want slides which are shallow in the vertical direction to keep the slide unobtrusive, and enable use with short drawers.

In most drawer slides of the prior art, the four separate ball bearing assemblies are aligned in pairs on two spaced-apart vertical axes. To make a drawer slide thin in the horizontal direction, designers have focused on making the relative vertical separation of one pair of bearings narrower than the other. This enables the vertical axes of the bearing pairs to become nearly collinear, resulting in a thin slide.

For example, U.S. Pat. No. 5,022,768 (Baxter) discloses, in FIG. 1, a prior art slide mechanism in which the ball bearing pairs are on nearly collinear vertical axes. FIGS. 3, 4, and 7 of U.S. Pat. No. 4,469,384 (Fler et al.) discloses a similar collinear axis slide. However, the cross-section profile of the resulting slide is not symmetrical, requiring the separate fabrication of a fixed cabinet member and a moving drawer member, each having a different cross-section. This increases manufacturing costs and increases the height profile of the slide.

Thus, designers of drawer slides desire to provide a slide which is horizontally thin and vertically short to enable unobtrusive installation in a variety of furniture mounting arrangements. Designers of drawer slides also desire to provide a slide in which the central slide member is structurally stable.

Another goal of slide design is smooth control of extension of the slide. U.S. Pat. No. 4,662,761 discloses a multi-part slide with a roller 18. This slide requires four outside channel members and separate plates 57, 58 to join the channels together. The bearings are arranged on a vertical collinear axis. The roller 18 has a horizontal axis of rotation and provides sequential motion rather than smooth progressive movement.

U.S. Pat. No. 3,966,273 shows a slide with progressive movement control of a ball retainer using bands of material which impose friction. U.S. Pat. No. 3,901,564 shows a slide with a progression roller 38 having a horizontal axis of rotation. The roller imposes friction on the outer channel members of the slide.

U.S. Pat. No. 3,857,618 shows control of a ball retainer using a rack and pinion arrangement best seen in FIG. 11. The pinion gear has a horizontal axis of rotation but requires clearance space at the bottom of the slide channel members, thereby increasing the overall height of the slide. Punched holes are required in the slide.

U.S. Pat. No. 3,679,275 shows a drawer slide with four outer channel members and a roller 66 mounted on a vertical shaft 68. The roller has a knurled outer surface which imposes friction on the inside faces of outer plates 16, 36 which hold the four channel members together. This requires special preparation of the slide member surfaces, which leads to higher manufacturing costs and greater complexity of design. Also, the '275 patent requires two separate sets of sliding components.

Thus, the prior art fails to provide a drawer slide which is horizontally thin and vertically shallow or short, and also incorporates a progression roller system. The prior art also fails to provide a slide with a progression roller which can facilitate closure of the slide, act as a detent, and also release pressure on the roller when the slide is closed. A particular disadvantage of prior art slides with progression rollers is that when closed, the roller is in constant compression within the slide. This results in permanent flattening or deformation of the roller over time. This causes undesirable bumpy movement of the slide.

SUMMARY OF INVENTION

Accordingly, the present invention provides a thin profile drawer slide apparatus for slidably supporting a heavy drawer in an article of furniture, comprising symmetrical, identical fixed cabinet and moving members or channels for slidably attaching the apparatus to a drawer and an article of furniture, a plurality of bearings slidably retained in the channels by bearing retainers, and by an intermediate retaining means. The intermediate retaining means preferably comprises an intermediate slide member which is the unitarily formed combination of a generally vertical central wall, a first bearing raceway joined to an end of the central wall, and a second bearing raceway joined to an arcuate wall extending angularly outwardly from the first bearing raceway, whereby the first and second bearing raceways are vertically and angularly separated or offset.

The central wall of the inner retaining means comprises a generally rectangular window with a progression roller mounted therein on a vertical axis of rotation. The roller exerts friction on the inner faces of the channels by compression against the interior faces when the roller is moved. The edges of the window act as a detent on the roller and also urge the slide closed when the slide is brought to rest with the roller against one of the edges. The window provides means for releasing compression tension on the roller when the slide is fully closed.

Thus, the invention provides a horizontally thin, vertically short three-part slide with ball bearings arranged in four nearly collinear, slightly offset sets. Use of a single central member with raceways for four separate sets of bearings enables construction of a thin, strong drawer slide for carrying heavy loads.

DETAILED DESCRIPTION

In the following detailed description of the preferred embodiments, specific terminology is used for the sake of clarity. However, the invention is not limited to the specific terms selected, but includes all technical equivalents functioning in a substantially similar manner to achieve a substantially similar result.

General construction details of three part drawer slides are well known in the art. Relevant disclosures, showing typical prior art slides, ball bearing retainers, channel members and stop mechanisms include U.S. Pat. Nos. 4,537,450 (Baxter); 4,991,981 (Baxter); and the patent references discussed above in the section entitled "Background of the Invention." The reader is directed to these references for general construction details and configurations of three part drawer slides.

Figure 1:
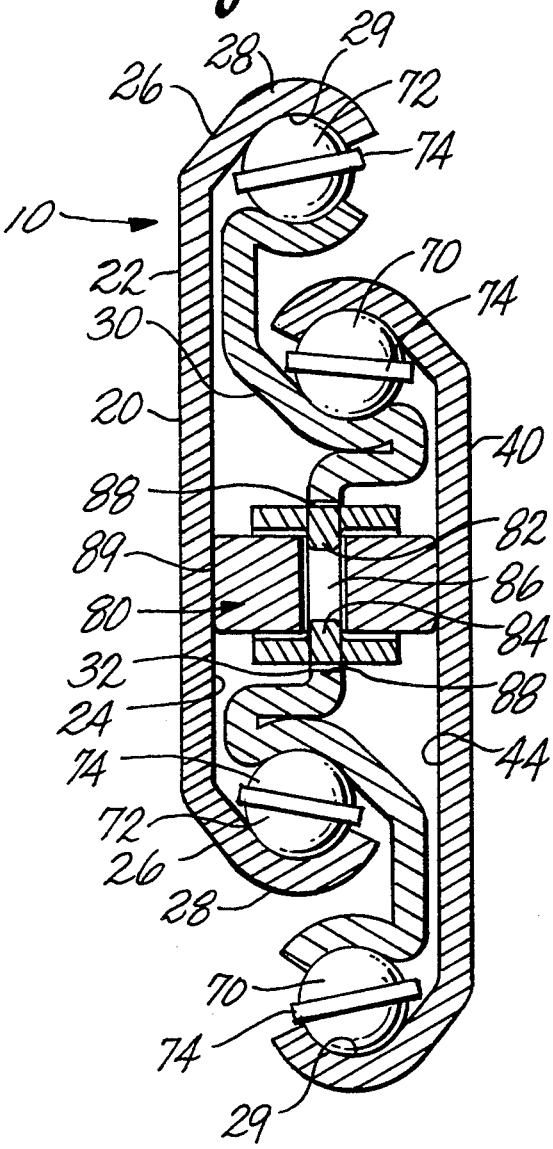
FIG. 1 is a cross-section view of a first embodiment of a three-part drawer slide with progression roller according to the invention.
Figure 5:
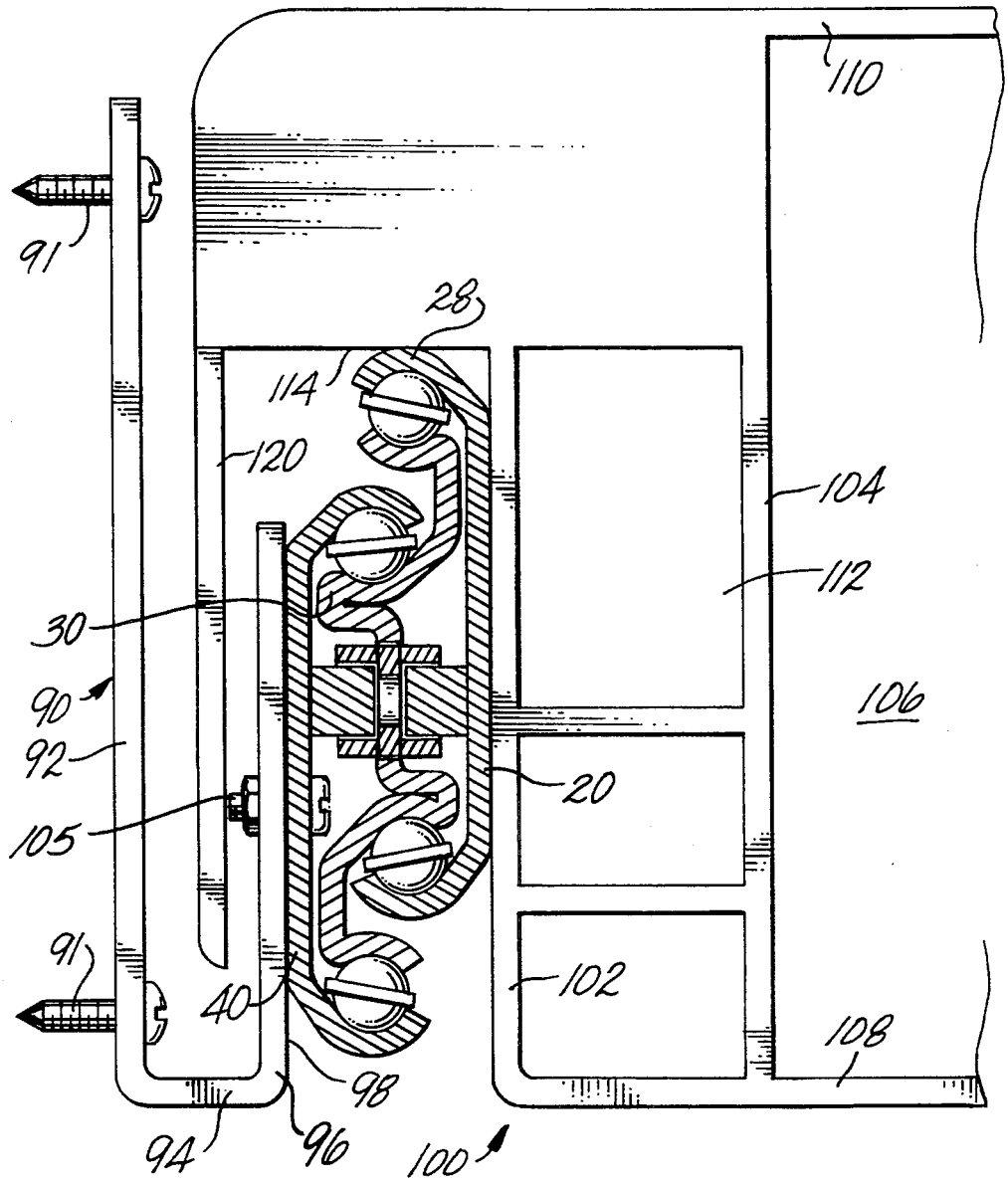
FIG. 5 is a partial elevation view of a drawer assembly showing the slide of FIG. 1 secured to a drawer and an article of furniture.

FIG. 1 shows a cross-section view of a drawer slide 10 according to the invention. FIGS. 6 to 11 show elevation and plan views of the slide of FIG. 1. The drawer slide comprises an outer slide member or outer channel member 20 which in a first of two alternate orientations is affixed to an interior wall of a stationary article of furniture; an intermediate slide member 30 which is slidable in the outer member 20; and an inner slide or channel member 40 which can be affixed to an outer surface of a side wall of a movable drawer. A second alternate orientation is shown in FIG. 5 and described below. A first set of ball bearings 70 enable outer slide member 40 to telescope in and out of the intermediate slide member 30. Likewise, a second set of ball bearings 72 mounted between intermediate member 30 and outer member 20 enable the intermediate member to slide through the outer member. To be retained in the channel members the bearings are rotatably or rollably mounted in bearing retainers or ball spacers 74. The retainers axially retain the bearings so as to keep each set together, while the channel members and intermediate slide member retain the bearings. A stop (not shown) can be provided to prevent the drawer from being pulled entirely out of the article of furniture.

The channel members 20, 40 preferably are symmetrically identical. The slide is mounted to the drawer and article of furniture via the channel members. The discussion below relates to details of the outer channel member 20 in FIG. 1, but the same parts are provided in symmetrically opposite locations on the inner channel member 40. The inner and outer channel members can be manufactured in identical form and assembled in opposite orientation and are elongated to any desired slide length. The channel members are preferably formed with a vertically elongated "C" shaped cross section using cold-rolled steel or other suitable material, and comprise a generally vertical or flat outer wall 22, upper and lower inwardly angled walls 26, and arcuate top and bottom walls 28. In this description, "inwardly" means toward a center axis of the intermediate slide member 30. The inner surfaces 29 of top and bottom walls 28 form raceways or trackways for the ball bearings 70, 72.

The intermediate slide member 30 preferably is formed in a single piece of steel or other suitable material. The intermediate member can be roll-formed or solid extruded metal. The unitary construction adds structural stability and reduces manufacturing costs of the entire apparatus. Moreover, the central member is symmetrical and may be inverted or reversed without affecting the operation of the mechanism. For clarity, details of the intermediate member 30 of FIG. 1 are identified by reference numerals on FIG. 3. One of ordinary skill in the art will readily understand that the intermediate members of FIGS. 1 and 3 are identical, except that the intermediate member of FIG. 1 additionally comprises a progression roller as discussed below.

Figure 3:
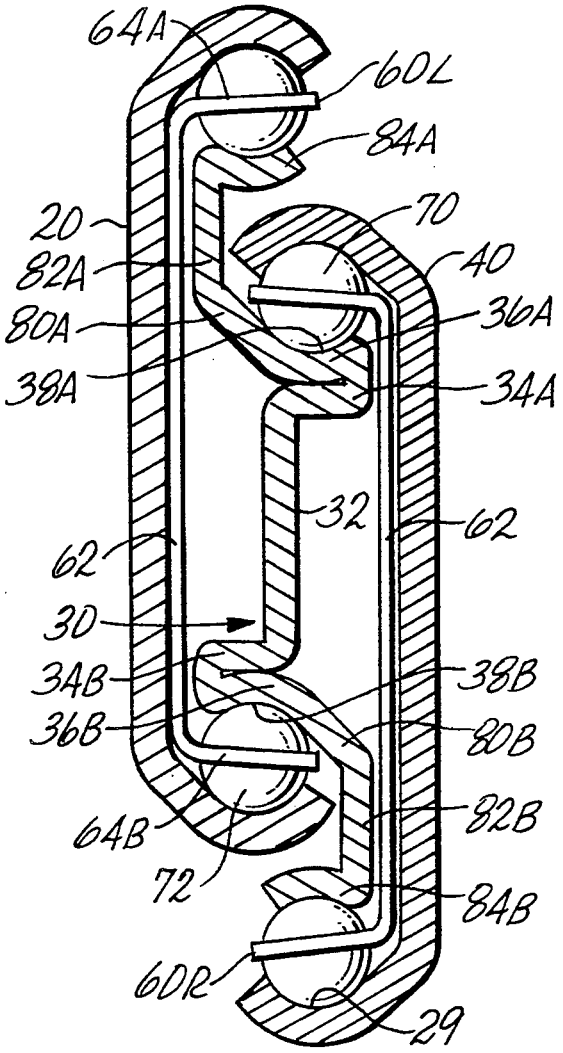
FIG. 3 is a cross-section view of a third embodiment of a drawer slide having no progression roller.

As indicated in FIG. 3, the intermediate slide member 30 comprises a central vertical wall 32 unitarily formed with upper and lower short horizontal walls 34A, 34B. Preferably, the horizontal walls are joined at an approximately right angle to the central wall. Using a sharp or hair pin bend, the walls 34A, 34B are joined to upper and lower parallel arcuate raceway members 36A, 36B. Preferably, each of the raceway members includes an arcuate raceway surface 38A, 38B. The raceways provide a second trackway or bearing surface for ball bearings 70, 72.

Thus, in operation, when the outer or inner channel members are moved axially in or out, the ball bearings 70, 72 will simultaneously rotate on the trackways formed by the inside face 29 of the outer and inner channel members and on the outward-facing raceways 38A, 38B on the intermediate slide member.

Preferably, a central vertical axis of the central wall 32 forms a center of gravity of the slide, so that a downward-bearing load placed on the top of channel member 20 is directed down into the central wall.

The intermediate member 30 further comprises angled arms 80A, 80B joined at one end to raceway members 36A, 36B. The opposite end of the angled arms 80A, 80B is joined to short vertical walls 82A, 82B. These vertical walls are joined at their upper ends to arcuate upper and lower raceways 84A, 84B. These upper and lower raceways provide a ball bearing trackway or raceway directly opposite raceways 29. This combination of elements provides an intermediate member enabling four sets of ball bearings to be arranged on nearly collinear axes, minimizing the horizontal thickness and the vertical height of the slide.

The structure of the intermediate member also enables greater "wrap" around the ball bearings 70, 72. As is known in the art, "wrap" refers to the amount of perimeter surface of the bearing which is covered or guided by a raceway. A large amount of wrap is desirable to prevent lateral disembodiment (pulling apart) of the slide. As shown in FIGS. 1 and 3, the ball bearings 70, 72 are nearly encircled completely by raceways 29, 84A and arcuate member 28 and raceway 38A, 38B.

The slide of FIG. 1 also comprises a progression roller 80 which can rotate on a vertical axis on axles 82, 84. Preferably the roller comprises a resilient material such as soft rubber with a steel core. The axles are formed in a window or cutout 86 of central wall 32 of intermediate member 30. When the slide is opened or closed, as discussed below, the perimeter surface 89 of the roller rolls against the interior faces 24, 44 of the channel members 20, 40. Friction caused by contact of the rubber roller with the metal channel members enables smooth, controlled, progressive opening and closing of the slide. Unlike the prior art, the central mounting location of the roller enables use of a progression roller in a horizontally thin and vertically short slide.

Unlike two-part drawer slides, three-part drawer slides permit full outward extension of a drawer from a cabinet. The progression roller enables smooth and controlled extension of the slide without hitting noise. Three-part slides without progression rollers produce several "clicks" caused by the drawer slide members hitting together as the slide extends. Typically, when a drawer with a prior art slide is pulled out, the movable inner member first extends to its entire length. Inwardly protruding end tabs on the inner member strike the end of the intermediate member, causing "pick up noise" (a "click") and pulling the intermediate member out. When the slide reaches full extension there is another "click" as end tabs on the intermediate member strike stop tabs on the stationary outer member. This phenomenon is well known in the art. It is also possible for the intermediate member to extend first, followed by the movable inner member, but the double click effect is the same.

In contrast, in a slide of the present invention, when a drawer is pulled out of an article of furniture, the inner member extends and the intermediate slide member is also carried forward by the progression roller. As a result, both the movable inner member and the intermediate member extend from the stationary outer member at the same rate, preventing hitting noise or "clicks."

Figure 6:
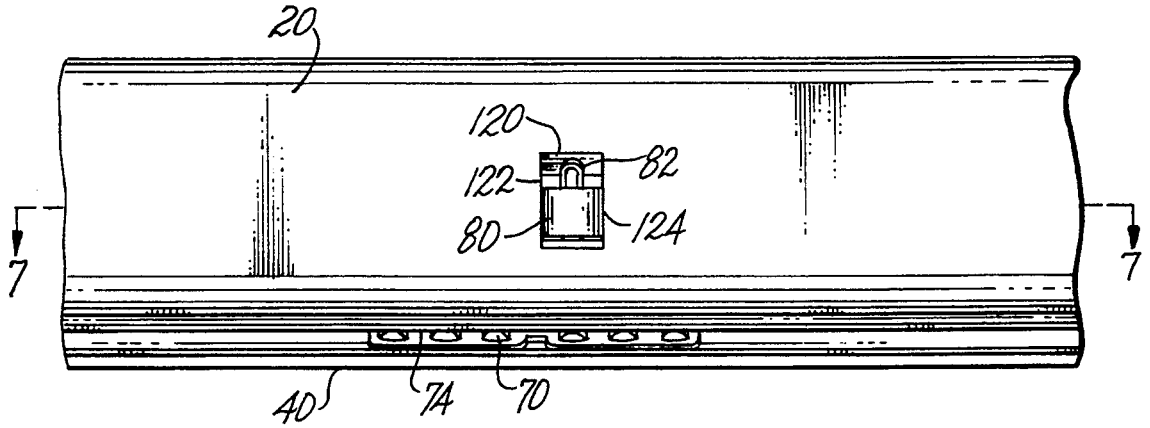
FIG. 6 is an elevation view of the drawer slide of FIG. 1, showing the slide in a fully closed position.
Figure 7:
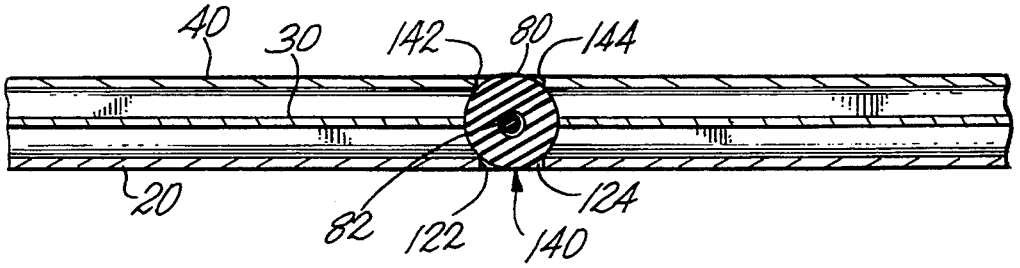
FIG. 7 is a section view of the slide of FIGS. 1 and 6 taken on line 7—7 of FIG. 6.

Operation of the progression roller in the slide of FIG. 1 is shown in FIGS. 6 to 11. FIGS. 6 and 7 show elevation and section views, respectively, of the slide of FIG. 1 in the closed position. At least one clearance window 120 is provided in the outer channel member 20. The window 120 preferably comprises a generally rectangular cutout in the outer channel member. The window has a leading edge 122 and a trailing edge 124. When the slide is closed, the roller 80 protrudes through the window, as shown in FIG. 7, and the perimeter surface of the roller rests against the leading and trailing edges 122, 124, 142, 144. Inner channel member 40 has a corresponding window or cutout 140 with a leading edge 142 and a trailing edge 144. When the slide is closed, the windows 120, 140 are opposite one another. In this closed position, the edges of the window act as a detent on the roller. Slight side-to-side pressure on the slide will not cause the slide to move since the protruding roller is abutted against edges 122, 124, 142, 144.

Figure 8:
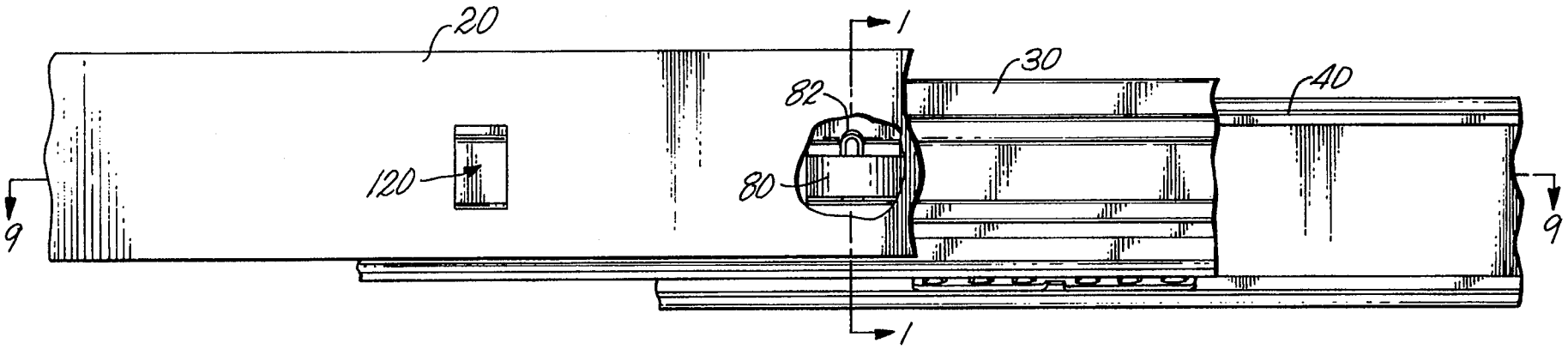
FIG. 8 is an elevation view of the drawer slide of FIG. 1, showing the slide in an open position.
Figure 9:
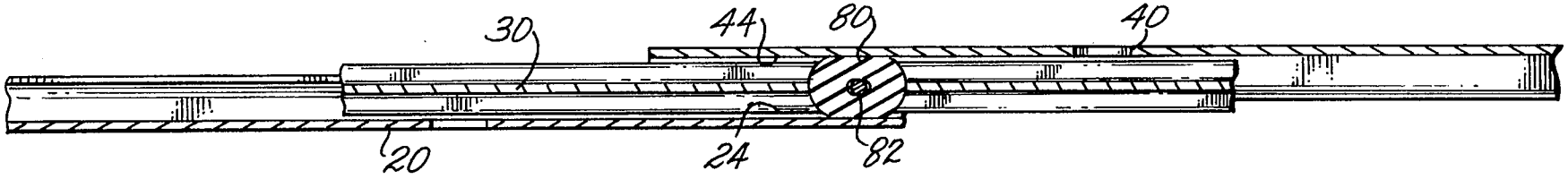
FIG. 9 is a section view of the slide of FIGS. 1 and 8 taken on line 9—9 of FIG. 8 with an exaggerated representation of a roller.

However, firm pressure on the slidable members of the slide will cause the roller to compress inside the slide, moving under edges 124, 142 and assuming the deformed shape shown in exaggerated form in FIGS. 8 and 9. As shown in FIG. 8, when the slide is opened, the roller moves past the window 120 and is compressed between the interior surfaces 24, 44 of outer member 20 and inner member 40. The compression of the roller 80 exerts friction on the channel members, insuring that the slide parts extend smoothly and at a proportional rate. This eliminates the hitting phenomenon found in prior art slides. The progression roller feature also balances the load on the slide, thereby increasing life of the slide.

The window 120 also acts as a decompression mechanism for the roller. In prior art slides with a roller located between outer and inner channel members of a slide, the roller is compressed even when the slide is completely closed. As a result, over time, constant compression of the roller can cause the roller to assume a distorted shape, or lose its compressive tension entirely. This is known in the art as "taking a set" and results in a malfunction of the roller. In the present invention, the windows 120, 140 enable the roller to release compressive tension when the slide and drawer are completely closed. The window prevents flat spots from forming on the roller when it is in continuous compression. This extends the life of the roller and improves its performance.

Figure 10:
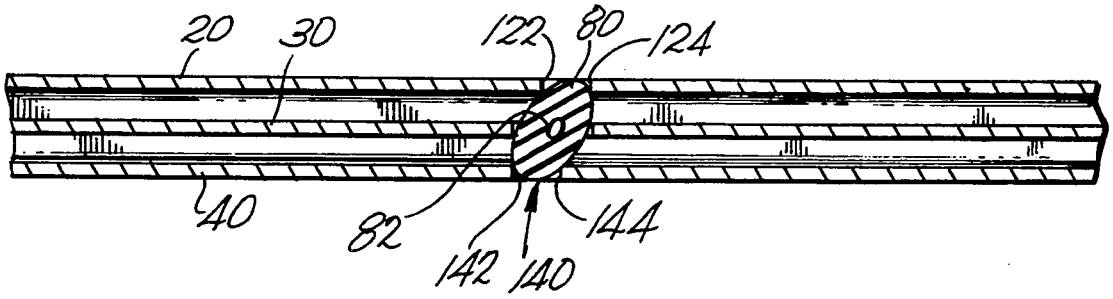
FIG. 10 is a partial cross-section view of the slide of FIG. 1 in a nearly closed position.
Figure 11:
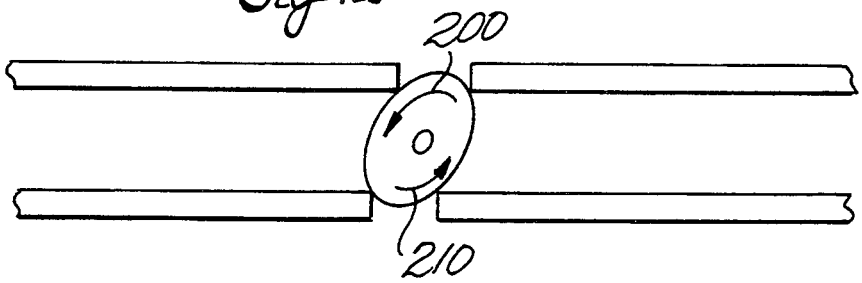
FIG. 11 is a partial schematic view of the slide of FIG. 10 showing rotational stress on the roller.

The roller also provides a self-closing effect, as illustrated in FIGS. 10 and 11. FIG. 10 provides a section view of the slide of FIGS. 7 and 9, in which the slide channel members are almost closed. In this position, the windows 120, 140 are slightly offset, and the roller assumes an oval shape. Part of the perimeter surface of the roller extends into the windows 120, 140, and a portion of the roller remains compressed in the slide. In this position, rotational tension develops in the roller as indicated by arrows 200, 210 in FIG. 11. This tension urges the roller to rotate, thereby causing the slide to close completely. Thus, if the slide is closed part way, such as by a user pushing a drawer with insufficient pressure to close the drawer completely, the roller will tend to urge the slide (and the drawer) closed. This prevents slides and drawers from stopping in a slightly open position.

In an alternative embodiment, the leading and trailing edges of the windows can be formed at an angle, or can be beveled, so as to enhance or retard detent action of the window.

The roller additionally prevents "creep" of the slide. The friction exerted on the outer and inner channel members by the roller under compression increases the force required to move the slide. This causes the slide to remain in a desired position until sufficient force is exerted on the slide to overcome the friction exerted by the roller.

In an alternate contemplated embodiment, the outer and inner channel members can be provided with multiple windows, thereby enabling use of the windows as detents or multiple stop positions for the slide. The roller can comprise any resilient material and can be synthetic.

Figure 2:
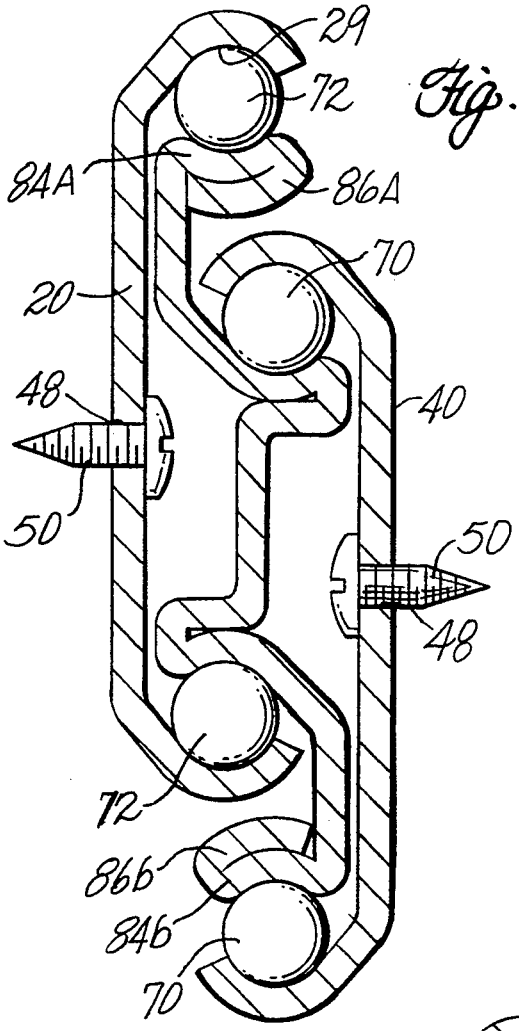
FIG. 2 is a cross-section view of a second embodiment of a drawer slide, with double-thickness intermediate member raceways, having no bearing retainers and showing fasteners for securing the slide.

Referring to FIG. 2, an alternate embodiment slide is shown. Symmetrically identical left and right (outer and inner) channel members or channel means 20, 40 are provided for slidably attaching the slide to an article of furniture and a drawer. One or more holes 48 can be provided in the vertical wall to enable securement of the slide apparatus to a drawer or an article of furniture using a threaded fastener 50. Preferably, a #6 pan head screw is used for fastening the slide to furniture. Of course, any suitable type of fastener can be used. The fasteners must be flush with the channel or member surface so as to ensure that the roller does not roll over or against the heads of the fasteners. The fasteners could comprise flat head counter sunk threaded screws or bayonets.

Also, in the embodiment of FIG. 2, the raceway members 84A, 84B are joined by an additional hairpin bend to secondary raceway members 86A, 86B. These members provide double-thickness raceways for the intermediate member, thereby increasing the load which the slide can carry.

In the embodiment of FIG. 3, the ball bearings 70 are retained in left and right bridge-type bearing retainers 60L, 60R. The ball bearing retainers are symmetrically identical, thereby reducing manufacturing costs by enabling a single type of retainer to be used on both sides of the apparatus. As is known in the art, each bridge type bearing retainer holds two sets of ball bearings to cause both sets to move synchronously. Both left and right retainers 60L, 60R include corresponding parts in a like arrangement. The left ball bearing retainer 60L includes a central vertical wall 62. The vertical wall 62 is joined using upper and lower angled walls 64A, 64B. Each angled wall has a plurality of spaced-apart holes or pockets (not shown) in which the ball bearings rotate. The general construction of ball bearing retainers is well-known in the art. For example, the ball bearing retainer disclosed in U.S. Pat. No. 4,991,981 (Baxter) is suitable for incorporation in the mechanism disclosed herein.

Figure 4:
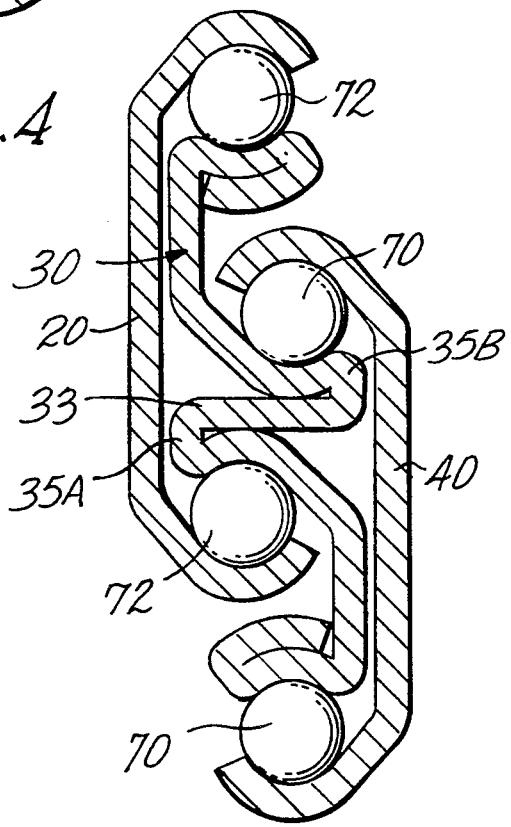
FIG. 4 is a cross-section view of a fourth embodiment of a drawer slide according to the invention.

Another alternate embodiment is shown in FIG. 4. In this embodiment, the intermediate member 30 does not comprise a vertical central wall 32. Instead, the intermediate member comprises a generally horizontal central wall 33 joined by a sharp bend to one end of two short vertical walls 35A, 35B. The opposite end of these walls is joined to the raceway members 36A, 36B. Use of a horizontal central wall 33 in place of the vertical central wall 32 enables the embodiment of FIG. 4 to be vertically shorter than the embodiments of FIGS. 1, 2, and 3. Preferably, the overall height of a side of FIG. 4 is approximately 32 millimeters, and its overall width is about 13 millimeters. The embodiment of FIG. 4 provides a high-strength, heavy-duty miniature drawer slide in which four sets of bearings are provided in a vertically and horizontally compact arrangement.

As shown in FIG. 5, the offset positioning of the channel members facilitates attachment of a slide to a drawer and an article of furniture with the slide in the aforementioned second orientation. In the prior art, slide attachment brackets (not shown) are required to enable attachment of a drawer slide in the arrangement of FIG. 5. The offset channel arrangement of the present invention enables the top surface of the movable channel member 20 to act as a load-bearing member for the drawer.

In this arrangement, a "U"-shaped bracket 90 is provided and secured to the channel member 40 using welding or with a suitable fastener, or using bayonets provided on the exterior surface of the channel member 40. The bracket can comprise a generally vertical wall 92, a horizontal bottom wall 94 joined at a right angle to the vertical wall, and an inner vertical wall 96 which can be joined to the slide. Preferably channel member 40 is welded to the vertical wall 96 or secured thereto using a fastener 105. The bracket can be affixed to an article of furniture using suitable fasteners such as screws 91.

The drawer 100 comprises top and bottom walls 110, 108 which are spaced apart by an inner vertical wall 104. Storage space 106 is provided in the drawer. An inner vertical wall 102 is provided in spaced-apart relation to the vertical wall 104. Preferably channel member or drawer member 20 is fixed to the wall 102 using brackets or other fastening means (not shown).

The drawer also comprises a load-bearing wall 114 which can be mounted directly on the arcuate wall 28 of the slide. This enables the outer channel member 20 to transfer load from the drawer to the intermediate member, thereby reducing shear load on whatever fastening means is used. A fascia panel 120 can be provided, to prevent the drawer slide from being visible when the drawer is open.

The ball bearings may be constructed of steel, plastic, ceramic, or any suitable material, and the slide members can comprise steel, stainless steel, plastic, aluminum, or any similar suitable material.

As indicated above, the present invention provides a novel and unique apparatus for facilitating support and smooth sliding of drawers in articles of furniture. A unitarily-formed central or intermediate slide member provides a plurality of raceways for four separate sets of ball bearings, with reduced manufacturing costs and simpler construction than the prior art. Drawer slides according to the invention may be used in a variety of nondrawer applications such as extendable writing surfaces of desks and other applications known in the art.

The invention may be practiced in many ways other than as specifically disclosed herein. For example, the drawings are not rendered to scale and the size of the walls can be modified. In one contemplated embodiment, elongated plastic strips are affixed to the interior faces of the channel members, thereby increasing friction exerted by the progression roller. The plastic strip can be smooth or knurled. Positive progression can be provided by forming the strips as a rack and using a pinion gear instead of a smooth roller. Bayonet mounting tabs can be formed in the channel members to facilitate mounting the slide on metal furniture. Bayonets are preferred for the embodiment of FIG. 1 and FIG. 4 since use of fasteners protruding through the channel members is impractical with these embodiments.

Thus, the scope of the invention should be determined from the appended claims.

What is claimed is:

1. A slide apparatus comprising:

means for mounting the apparatus to a drawer and to furniture comprising two opposed generally "C" shaped channel members;

a plurality of bearings rollably retained in the means for mounting the apparatus by at least one bearing retainer; and an intermediate slide member comprising a central wall having a roller clearance window with a resilient progression roller mounted therein for rotation about a generally vertical axis, said progression roller is deformably mounted under compression so that a perimeter surface of the roller contacts interior surfaces of the channel members and controls motion of the channel members by friction between the roller and the channel members and wherein each of the channel members further comprises at least one roller clearance window through which the roller protrudes with reduced compression and deformation when the apparatus is in a fully closed position.

2. The apparatus of claim 1, wherein each said clearance window of the channel members comprises a generally rectangular cutout.

3. The apparatus of claim 2, wherein each said rectangular cutout of each said clearance window of the channel members comprises leading and trailing edges spaced apart by an overall width less than a diameter of the roller, whereby the leading and trailing edges retard motion of the roller when the apparatus is in the fully closed position.

4. A slide mechanism comprising first and second channel members and four sets of bearings rollable on and retained by an intermediate slide member comprising a unitarily formed combination of a central wall, a first pair of bearing raceways joined to ends of the central wall, and a second pair of raceways each joined to a wall extending angularly outwardly from one of the first pair of bearing raceways, wherein the central wall is generally vertical and further comprises a roller clearance window with a progression roller mounted therein for rotation about a generally vertical axis.

5. A slide mechanism comprising first and second channel members and four sets of bearings rollable on and retained by an intermediate slide member comprising a unitarily formed combination of a central wall, a first pair of bearing raceways joined to ends of the central wall, and a second pair of raceways each joined to a wall extending angularly outwardly from one of the first pair of bearing raceways, wherein the central wall is generally vertical and further comprises a progression roller mounted therein under compression for rotation about a generally vertical axis, wherein a perimeter surface of the roller contacts interior surfaces of the channel members and controls motion of the channel members by friction between the roller and the channel members.

6. The slide mechanism of claim 5, wherein each of the channel members further comprises at least one roller clearance window through which the roller protrudes without compression when the slide mechanism is in a fully closed position.

7. The slide mechanism of claim 6, wherein each said clearance window comprises leading and trailing edges spaced apart by an overall width less than a diameter of the roller, whereby the leading and trailing edges provide detents to restrict motion of the roller when the slide mechanism is in the fully closed position.

8. On a drawer movable in an article of furniture, a slide mechanism comprising two opposed generally "C" shaped outside channel members and a plurality of bearings retained by, and rotatable on said channel members, an intermediate slide member comprising a unitarily formed combination of a central wall, a first pair of bearing raceways joined to ends of the central wall, and a second pair of bearing raceways each joined to a wall extending angularly outwardly from one of the first pair of bearing raceway, wherein the central wall is generally vertical and further comprises a roller clearance window with a progression roller mounted therein for rotation about a generally vertical axis.

9. On a drawer movable in an article of furniture, a slide mechanism comprising two opposed generally "C" shaped outside channel members and a plurality of bearings retained by, and rotatable on said channel members, an intermediate slide member comprising a unitarily formed combination of a central wall, a first pair of bearing raceways joined to ends of the central wall, and a second pair of bearing raceways each joined to a wall extending angularly outwardly from one of the first pair of bearing raceways, wherein the central wall is generally vertical and further comprises a progression roller mounted therein under compression for rotation about a generally vertical axis, wherein a perimeter surface of the roller contacts interior surfaces of the channel members and controls motion of the channel members by friction between the roller and the channel members.

10. The slide mechanism of claim 9, wherein each of the channel members further comprises at least one roller clearance window through which the roller protrudes without compression when the slide mechanism is in a fully closed position.

11. The slide mechanism of claim 10, wherein each said clearance window of the channel members comprises leading and trailing edges spaced apart by an overall width less than a diameter of the roller, whereby the leading and trailing edges provide detents to impair motion of the roller when the slide mechanism is in the closed position.

12. On a drawer movable in an article of furniture, a slide mechanism comprising two opposed generally "C" shaped channel members and a plurality of bearings rollable on and retained by said channel members, an intermediate slide member comprising a central wall unitarily formed with a first pair of top and bottom double-thickness bearing raceways joined to ends of the central wall, and a second pair of bearing raceways each joined to a wall extending angularly outwardly from one of the first pair of top and bottom double-thickness bearing raceways, wherein the central wall is generally vertical and further comprises a progression roller mounted therein under compression for rotation about a generally vertical axis, wherein a perimeter surface of the roller contacts interior surfaces of the channel members and controls motion of the channel members by friction between the roller and the channel members, wherein each of the channel members further comprises at least one roller clearance window through which the roller protrudes without compression when the slide mechanism is in a fully closed position, and wherein each said clearance window comprises leading and trailing edges spaced apart by an overall width less than a diameter of the roller, whereby the leading and trailing edges act as detents on motion of the roller when the slide mechanism is in the closed position.

* * * * *